US011910981B2

(12) United States Patent
Haegermarck

(10) Patent No.: US 11,910,981 B2
(45) **Date of Patent: *Feb. 27, 2024**

(54) FLOW CONTROLLER FOR DISHWASHER

(71) Applicant: Electrolux Appliances Aktiebolag, Stockholm (SE)

(72) Inventor: Anders Haegermarck, Trångsund (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 204 days.

This patent is subject to a terminal disclaimer.

(21) Appl. No.: 17/312,726

(22) PCT Filed: Dec. 20, 2018

(86) PCT No.: PCT/EP2018/086203
§ 371 (c)(1),
(2) Date: Jun. 10, 2021

(87) PCT Pub. No.: WO2020/125995
PCT Pub. Date: Jun. 25, 2020

(65) Prior Publication Data

US 2022/0039631 A1 Feb. 10, 2022

(51) Int. Cl.
*A47L 15/42* (2006.01)
*A47L 15/22* (2006.01)

(52) U.S. Cl.
CPC ..... *A47L 15/4221* (2013.01); *A47L 15/22* (2013.01)

(58) Field of Classification Search
CPC ..... A47L 15/22; A47L 15/4221
See application file for complete search history.

(56) References Cited

U.S. PATENT DOCUMENTS 8,978,674 B2 3/2015 Busing et al.
9,801,522 B2 10/2017 Wee et al.
(Continued)

FOREIGN PATENT DOCUMENTS

DE 102007056922 A1 5/2009
EP 0383028 A2 8/1990
(Continued)

OTHER PUBLICATIONS

International Search Report and Written Opinion for International Application No. PCT/EP2018/086203, dated Sep. 3, 2019, 11 pages.

(Continued)

*Primary Examiner* — Benjamin L Osterhout
(74) *Attorney, Agent, or Firm* — Bradley Arant Boult Cummings LLP

(57) ABSTRACT

A flow controller for controlling water flow from a pump pumping water from a sump of a dishwasher to a water conduit system of the dishwasher. The flow controller comprises a plate with openings. The openings form water outlets to the water conduit system. The flow controller also comprises a disc rotatably arranged in relation to the plate. The disc comprises openings arranged for allowing closing and opening of the water outlets in the plate during rotation of the disc. The flow controller comprises a cavity formed between the disc and the plate configured to allow water to flow back from the water conduit system via a water outlet in the plate being closed by the disc and via the cavity to a drain outlet in the plate. Hereby water can return from a closed water outlet in the plate via the drain outlet in the disc to the sump.

7 Claims, 6 Drawing Sheets

(56) References Cited

U.S. PATENT DOCUMENTS

2006/0054194 A1* 3/2006 Choi ..... A47L 15/4221 134/58 D
2011/0290282 A1* 12/2011 Lee ..... A47L 15/4206 134/25.2
2013/0000762 A1* 1/2013 Buddharaju ..... A47L 15/4221 134/198
2013/0319482 A1* 12/2013 Vallejo Noriega ..... A47L 15/4285 134/99.1
2014/0069462 A1* 3/2014 Becker ..... A47L 15/4219 134/10
2014/0373876 A1* 12/2014 Feddema ..... A47L 15/4202 134/10
2015/0090306 A1* 4/2015 Boyer ..... A47L 15/23 134/184
2016/0066765 A1* 3/2016 Boyer ..... A47L 15/4221 137/486
2017/0071442 A1 3/2017 Boyer et al.
2017/0071443 A1 3/2017 Boyer et al.
2017/0172374 A1* 6/2017 Fountain ..... A47L 15/22

FOREIGN PATENT DOCUMENTS

EP 2687142 B1 1/2014
WO 2012114245 A1 8/2012

OTHER PUBLICATIONS

International Search Report and Written Opinion for International Application No. PCT/EP2018/086211, dated Aug. 22, 2019, 12 pages.
European Communication for European Application No. 18 826 667.0, dated May 15, 2023, 5 pages.

* cited by examiner

FLOW CONTROLLER FOR DISHWASHER

This application is a U.S. National Phase application of PCT International Application No. PCT/EP2018/086203, filed Dec. 20, 2018, which is incorporated by reference herein.

TECHNICAL FIELD

The invention relates to a flow controller for a dishwasher. The present invention also relates to a dishwasher with a flow controller.

BACKGROUND

A dishwasher typically comprises a sump disposed below a wash tub. The sump is configured to collect water from the dish washer. In the dishwasher a number of nozzles are provided. The nozzles are typically provided on spray arms. Most dishwashers have at least an upper and a lower spray arm. The sump is connected to a circulating pump configured to pump water collected in the sump. The water pumped by the pump can be pumped via some distributing element that determines which nozzles are to spray water at a particular point in time. Thus, by configuring the distributing element in a particular way the water can be pumped by the circulating pump to be sprayed via a determined set of spray arms. Accordingly, it is possible to independently perform an intensive wash mode of spraying water only through one of the spray arms. The distributing element can for example be a motor driven rotating disc configured to open and close outlets to the different spray arms. Such a distributing element can be termed a flow controller.

For example, U.S. Pat. No. 9,801,522 describes a rotating member driven by a motor to open and close holes for supplying water to spray nozzles.

There is a constant desire to improve various aspects of a flow controller. Hence there is a need for an improved flow controller.

SUMMARY

It is an object of the present invention to provide an improved flow controller.

This object and/or others are obtained by a device as set out in the appended claims.

In accordance with a first aspect of the invention a flow controller for controlling water flow from a pump pumping water from a sump of a dishwasher to a water conduit system of the dishwasher is provided. The flow controller comprises a plate with openings. The openings form water outlets to the water conduit system. The flow controller also comprises a disc rotatably arranged in relation to the plate. The disc comprises openings arranged for allowing closing and opening of the water outlets in the plate during rotation of the disc. The flow controller comprises a cavity formed between the disc and the plate configured to allow water to flow back from the water conduit system via a water outlet in the plate being closed by the disc and via the cavity to a-drain outlet in the plate. Hereby water can return from a closed water outlet in the plate via the drain outlet in the disc to the sump. This is advantageous because no or little water will be left unused in the water conduit system. In other words, because water can return from a closed part of the water conduit system no un-pressurized water will be left in a closed section of the water conduit system so that all water is efficiently used and the overall water consumption of the dishwasher can be reduced.

In accordance with one embodiment, the cavity is formed by at least one channel in the disc. Hereby an efficient implementation where the cavity used to return water to the drain outlet can be achieved.

In accordance with one embodiment, the at least one channel runs in a radial direction in the disc. Hereby an efficient location of the drain outlet is achieved. For example, the drain outlet in the plate can be located radially inside the water outlet. In particular the drain outlet can be located at a central location in the plate whereby the plate can be made with relatively small dimensions.

The invention also extends to a dish washer comprising a flow controller according to the above. The drain outlet can then advantageously be in fluid connection with at least one spray arm when a water outlet to said at least one spray arm is closed by the disc and or the drain outlet can be in fluid connection with at least one water when a water outlet to said at least one water tank is closed by the disc.

BRIEF DESCRIPTION OF THE DRAWINGS

The invention will now be described in more detail, by way of example, and with reference to the accompanying drawings, in which.

DETAILED DESCRIPTION

The invention will now be described more fully hereinafter with reference to the accompanying drawings, in which certain embodiments of the invention are shown. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. For example, like or similar components of different embodiments can be exchanged between different embodiments. Some components can be omitted from different embodiments. Like numbers refer to like elements throughout the description.

Figure 1A:
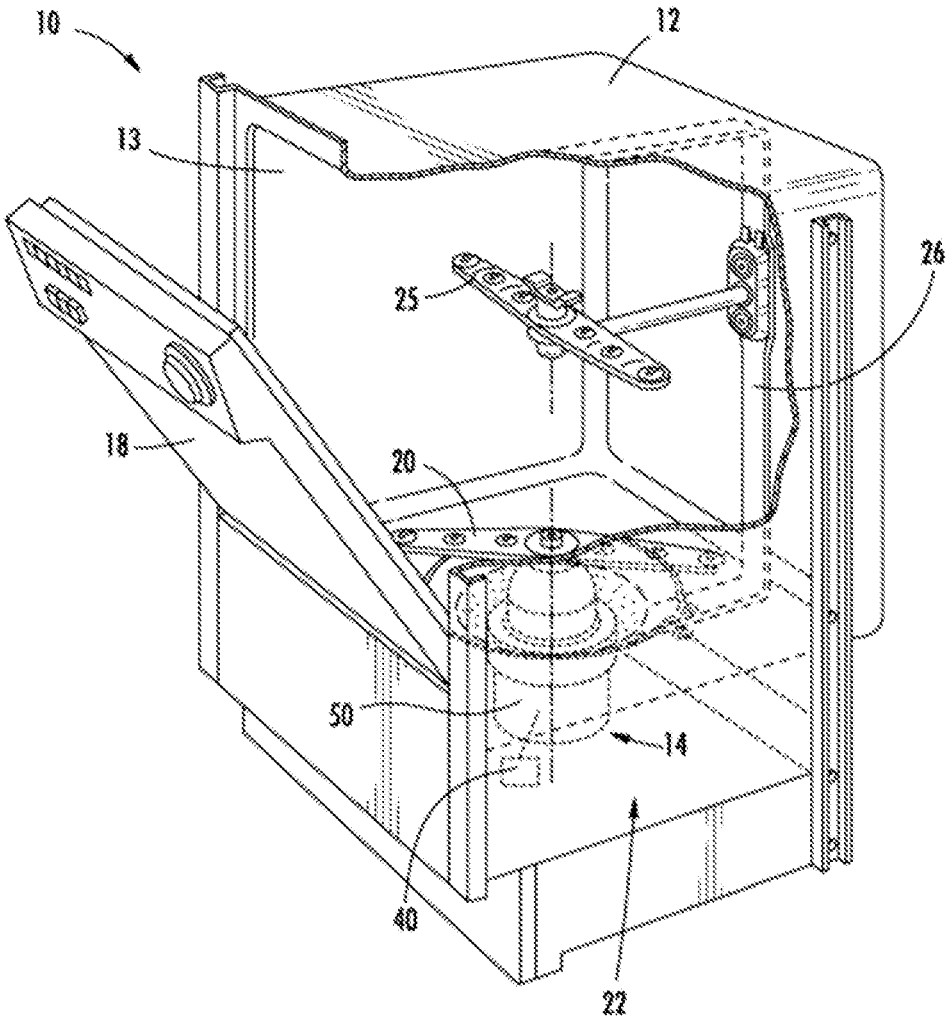
FIG. 1*a* is a view of a dishwasher.

FIG. 1*a* illustrates an example of a dishwasher 10. Such a dishwasher 10 typically includes a tub 12 (partly broken away in FIG. 1*a* to show internal details), having a plurality of walls (e.g., side wall 13) for forming an enclosure in which dishes, utensils, and other dishware may be placed for washing. The dishwasher 10 may also include slidable lower and upper racks (not shown) for holding the dishes, utensils, and dishware. A door 18 may be pivotably engaged with the tub 12 to selectively permit access to the interior of the tub 12. The door 18 may be configured to close in order to cover and seal the tub 12 when the dishwasher is in operation.

The tub 12 includes a sump 14 in which wash fluid or rinse fluid is collected, generally referred to as water, typically under the influence of gravity. The water may be pumped by a circulation pump 50 through a water conduit system 26 to one or more spray arms (e.g., lower spray arm 20 and/or middle spray arm 25) mounted in the interior of the tub 12 for spraying the wash fluid, under pressure, onto the dishes, utensils, and other dishware contained therein.

The dishwasher 10 may also comprise a controller 40 that may be in communication with one or more of the operational components of the dishwasher 10. For example, the controller 40 may be in communication with the circulation pump 50 and may be configured to selectively operate the circulation pump 50 to pump wash fluid to at least one spray arm and/or spray nozzle. In accordance with some embodiments the controller 40 can control a flow controller as will be described in more detail below. In some embodiments, the controller 40 may comprise a processor or other computing means such that operations can be performed in the dishwasher. Additionally, or alternatively, the controller 40 may comprise a memory for storage of data such as routines for operation of the dishwasher 10. In some embodiments, the controller 40 may be housed in the lower end 22 of the dishwasher 10.

Figure 1B:
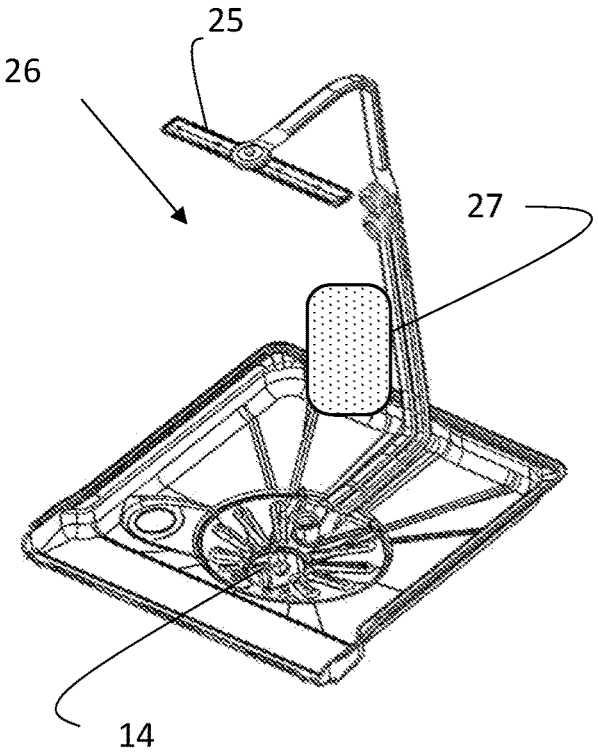
FIG. 1*b* shows a general view of a water conduit system for a dishwasher.

FIG. 1*b* shows a general view of a water conduit system 26 for a dish washer. The water conduit system is provided to spray water into a wash tub housed inside the dish washer and configured to wash dishes and the like placed in the dish washer. A sump 14 is located below the wash tub and configured to collect water used for washing.

Figure 2:
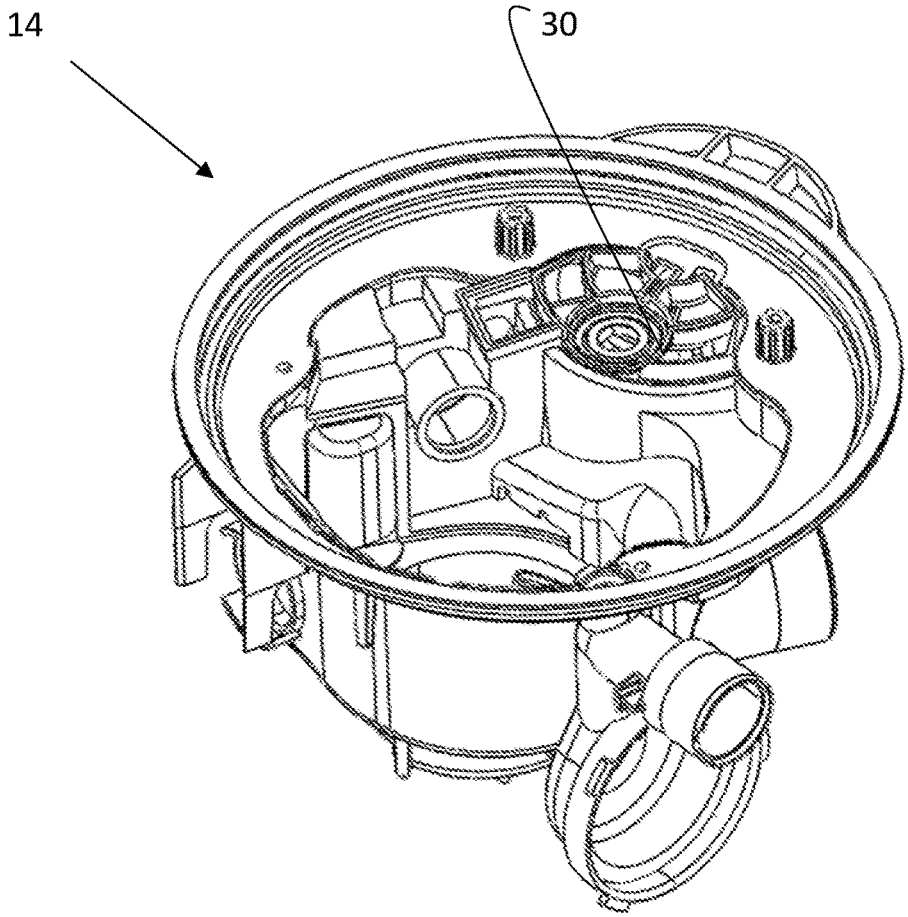
FIG. 2 is a view of a sump.

In the wash tub, a plurality of spray arms 25 are configured to spray water received when pumped from the sump 14 via the water distribution system 26 onto the dishes. While only one spray arm is depicted in FIG. 1*b* any number of spray arms may be used depending on the configuration of the dish washer. Typically, two or three spray arms are located within the wash tub. The water distribution system can also be connected to a water tank 27 for storing hot water that for example can be used in a heat exchange process The sump 14 is typically positioned at the center of the bottom of the wash tube, and act to collect washing water that is used for washing. FIG. 2 depicts a sump. The sump 14 comprises a flow controller 30 configured to receive pressurized water from the circulating pump (not shown). The circulating pump is configured to pump washing water collected in the sump 14 to circulate the washing water into the washing machine. The flow controller 30 acts to distribute water to the water distribution system in accordance with some programmed setting of the dish washer so that water is released at the desired locations in the dish washer.

Figure 3:
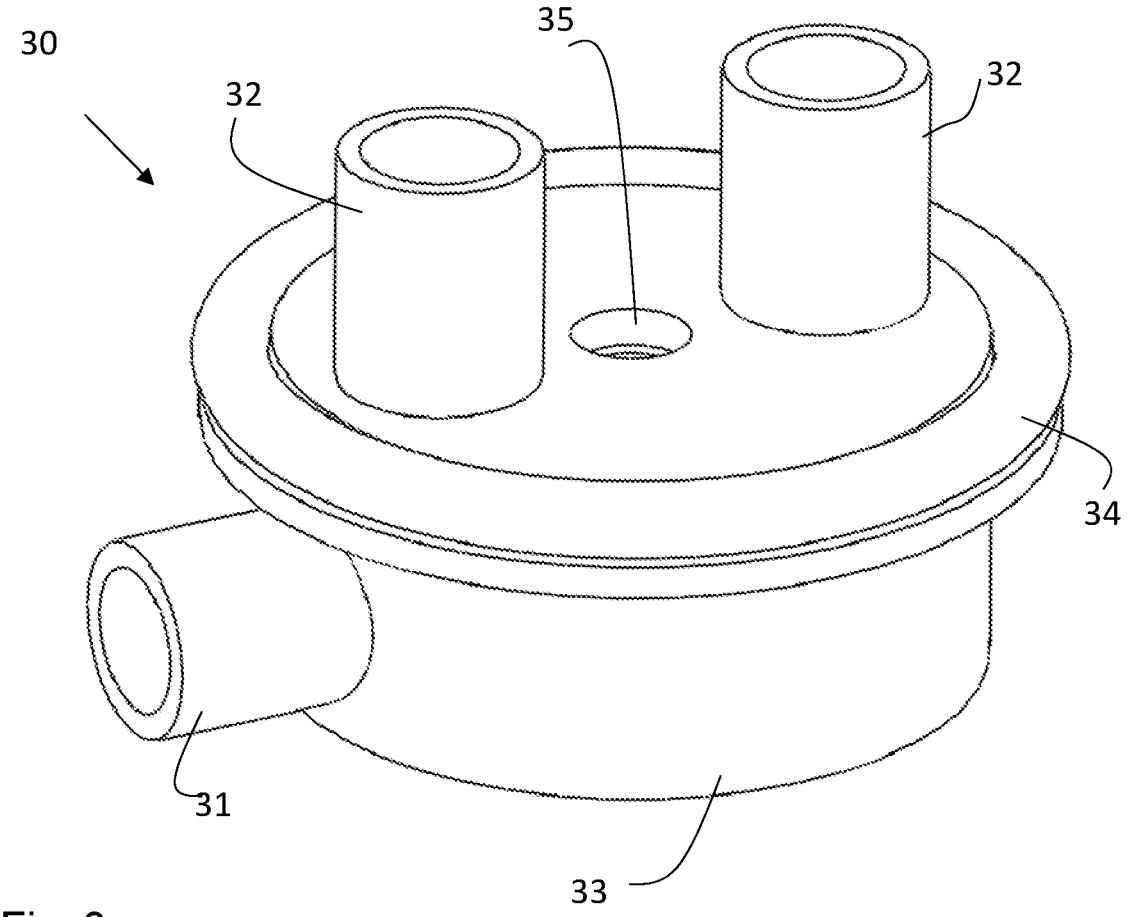
FIG. 3 is a view of a flow controller.

In FIG. 3, an exemplary flow controller 30 is shown. The flow controller 30 can receive pressurized water at an inlet 31 and pressurized water can exit the flow controller via a number of water outlets 32. In FIG. 3 two water outlets 32 are shown, but any number of water outlets can be provided. In accordance with some embodiments the water outlets are connectable to spray arms or other water nozzles. In accordance with some embodiments at least one of the water outlets 32 is not connected to a spray arm or a water nozzle. Such a water outlet can be connectable to a water tank for storing hot water. The hot water in the tank can be used in a heat exchanger. The flow controller can have a housing 33 having any suitable shape. In accordance with some embodiments the housing 33 has a generally circular shape and in particular the top part 34 of the housing 33 can be made circular. The flow controller can also comprise a drain outlet 35 as will be described in more detail below.

Figure 4:
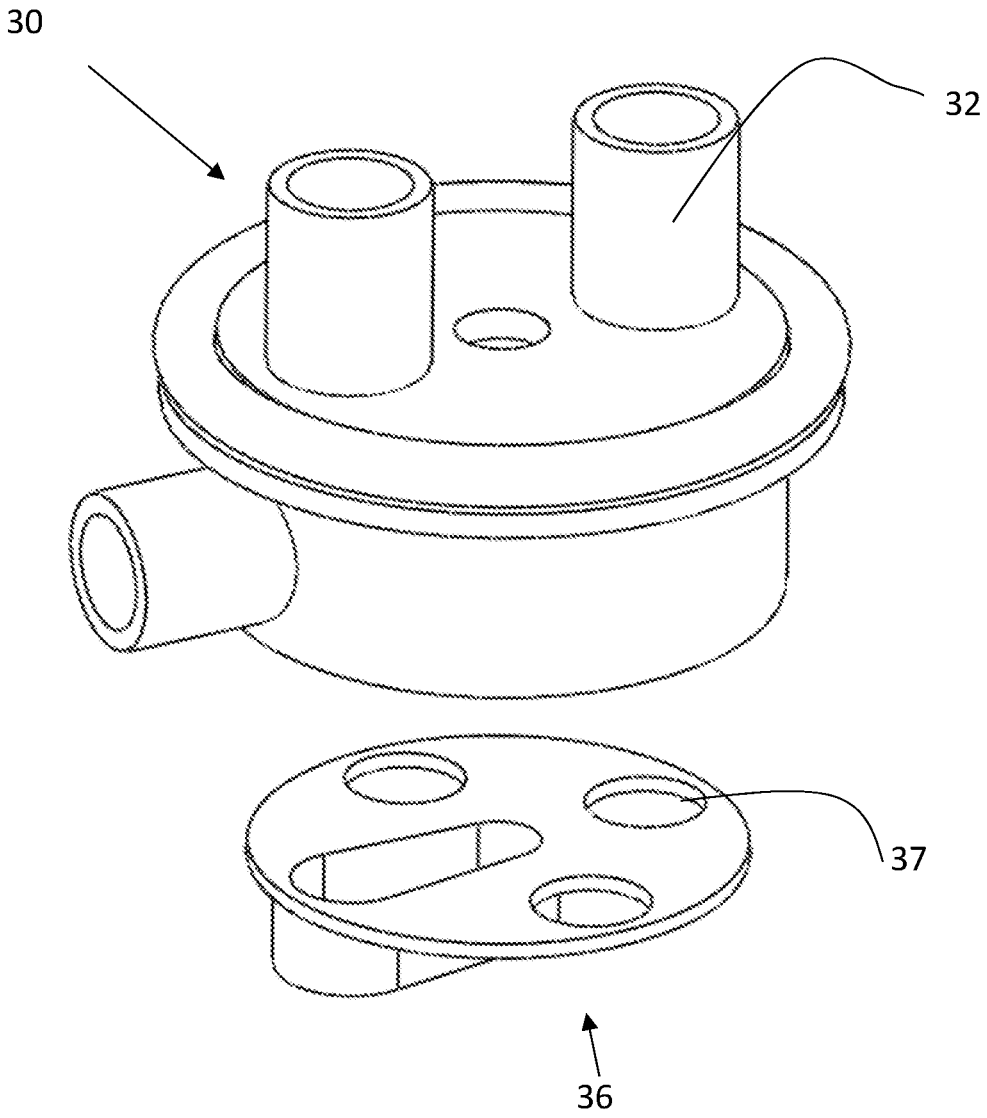
FIG. 4 is a view of a flow controller with a disc for controlling water flow removed.

The flow controller 30 is controlled to distribute pressurized water to some desired configuration of water outlets 32 by opening and closing the different water outlets 32 in some desired configuration. This can be obtained by rotating a disc with openings in the flow controller. In FIG. 4 a flow controller 30 is shown together with a disc 36 that can be made to rotate inside the flow controller 30. By rotating the disc 36, openings 37 in the disc 36 can allow for pressurized water to flow to the water outlets 32. Otherwise, when no opening 37 is placed at a particular water outlet 32, that particular water outlet 32 is closed and no pressurized water is fed to that particular water outlet 32.

Figure 5A:
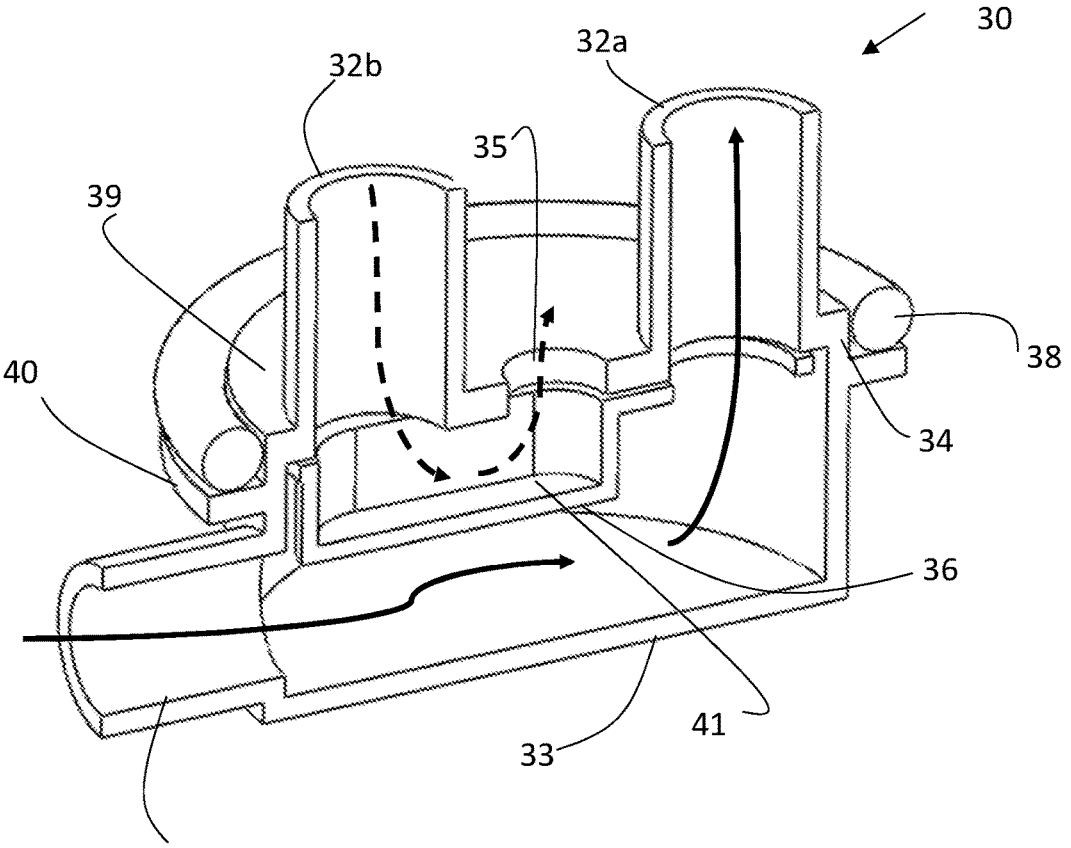
FIGS. 5*a* and 5*b* is a view illustrating an installed flow controller.

In FIG. 5*a*, a cross sectional view of the flow controller 30 is shown. The flow controller 30 can be arranged with a sealing 38 to seal the flow controller with pressurized water from the sump 14. This is shown in more detail in conjunction with FIG. 5*b*. In FIG. 5*a* the rotatable disc 36 is seen in position when interacting with a plate 39 in which plate 39 the water outlets 32 and a drain outlet 35 is formed. To rotate the disc, a motor (not shown) can be provided. The sealing 38 can be made circular when the housing 33 and in particular the top part 34 of the housing is made circular. The sealing 38 can rest on a flange 40 provided on the top part 34 of the housing 33. By sealing the housing 33 of the flow controller 30, there is no need to provide sealings for the individual water outlets 32, whereby the complexity of the flow controller can be reduced. Also, it becomes easier to reconfigure the flow controller by adding or altering water outlets in an existing configuration of water outlets. This is because only the plate 39 and the rotating disc 36 needs to be reconfigured.

Further illustrated in FIG. 5*a* is the water flow inside the flow controller 30. In FIG. 5*a* pressurized water is illustrated using solid arrows. Non-pressurized water is illustrated with dashed arrows. Thus, pressurized water entering the flow controller 30 via the inlet 31 can exit via an open water outlet such as water outlet 32*a* in FIG. 5*a*. A closed water outlet, such as water outlet 32*b* can return non-pressurized water to the sump. This can be performed by providing a cavity 41 between the disc 36 and the plate 39. The cavity 41 can provide a fluid connection between a water outlet 32*b* closed by the disc 36 and a drain outlet 35. Hereby water from the closed outlet 32*b* can return to the sump via the cavity 41 and the drain outlet 35. The drain outlet is in fluid connection with the sump. In the example of FIG. 5*a*, any water on top of the plate 39 will return to the sump since the top side of the plate 39 is in fluid connection with the sump and water can return by gravity force to the sump which typically is located at a low position in the dish washer. Any number of cavities can be formed in this way. The cavities 41 can be formed as channels and arranged to lead water radially from a water outlet 32 to the drain outlet 35. Hereby water in a water outlet from the flow controller 30 not provided with pressurized water can return to the sump and not stay in a water conduit not currently being supplied with pressurized water. This in turn can obtain a lower water consumption in the dish washer since no water is left in an unused water conduit. The cavity 41 can be formed in the disc 36. In accordance with some embodiments the cavity 41 is formed in the plate 39. In yet another embodiment the cavity is formed both in the disc 36 and in the plate 39.

Figure 5B:
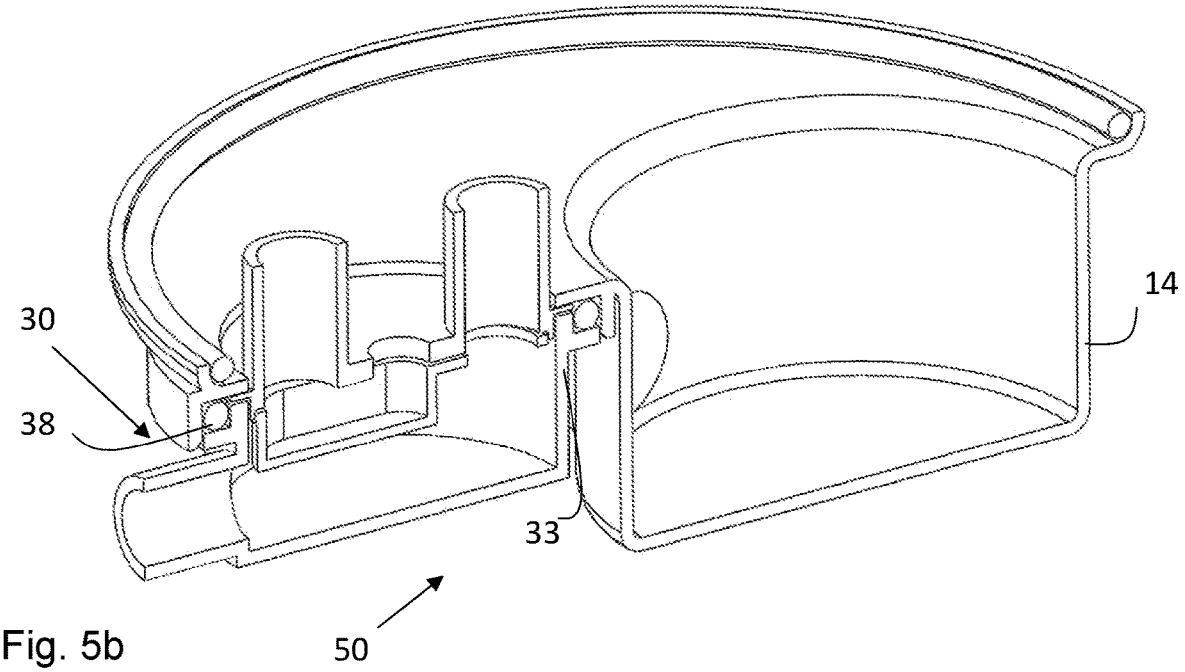

In FIG. 5*b*, the flow controller 30 is shown when installed together with the sump 14. The flow controller is installed in the sump 14 and the housing 33 of the flow controller 30 is fitted against the sump 14. In particular the housing 33 of the flow controller 30 can be fitted into the sump such that a part of the sump 14 will completely circumscribe the housing 33. In other words, there can be a wall of the sump 14 all around the housing 33 of the flow controller where the sealing 38 is arranged. Further, the sealing 38 that can be arranged between the housing 33 and the sump 14 will prevent any water exiting the flow controller 30 to enter a dry space of the dishwasher generally marked with reference 50 in FIG. 5*b*. Thus, all water exiting the flow controller 30 will end up in the sump 14 because the sealing 38 prevents water from leaking to the space 50 when the flow controller 30 is fitted against the sump with the sealing 38 arranged between the housing 33 and the sump 14. The sealing 38 can therefore prevent water on the topside of the flow controller to enter the space 50 and any water in the top side of the flow controller will return to the sump 14.

Figure 6:
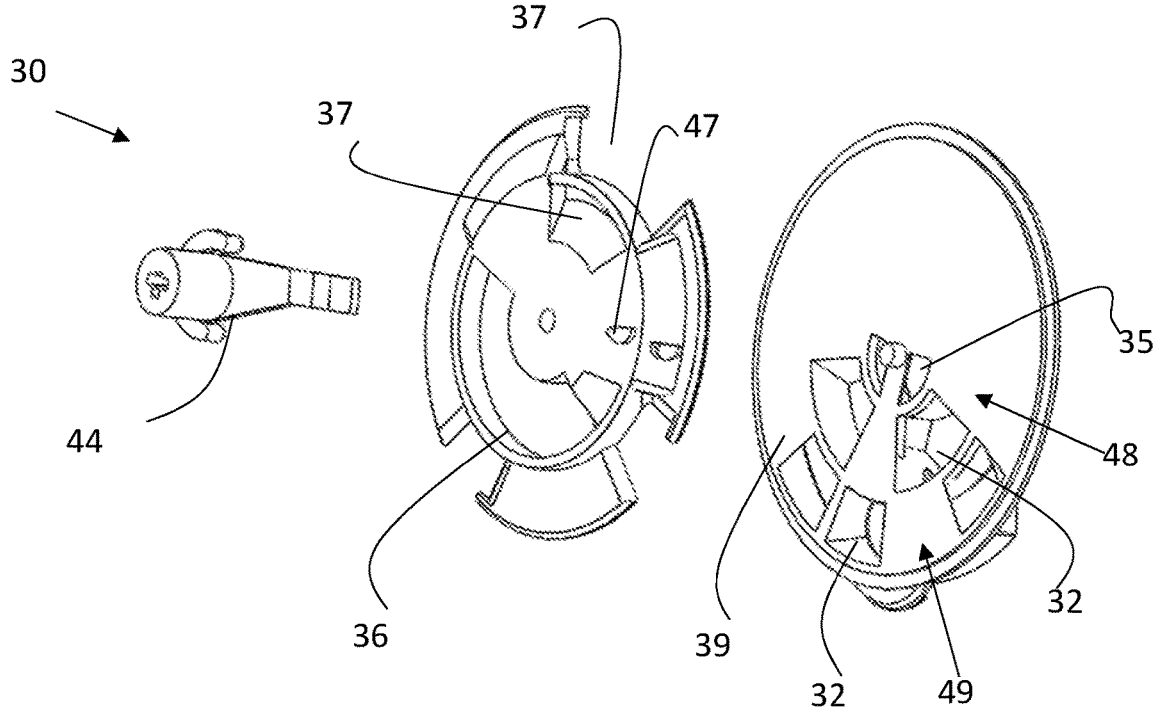
FIG. 6 is a view illustrating parts of a flow controller in accordance with an embodiment.

In FIG. 6 another embodiment of a flow controller 30 is depicted. In FIG. 6 only the plate 39 and the disc 36 are shown. The other parts of the flow controller 30 can for example be similar to the embodiment described in conjunction with FIG. 5. In the embodiment of FIG. 6 The disc 36 can, for example, be made to rotate by means of a motor driven arm 44 that co-operates with a protruding part 47 of the disc 36 to rotate the disc with respect to the plate. 39. The plate 39 can in accordance with some embodiments be circular and have essentially the same size as the disc 36. By opening and closing the different water outlets 32 by rotating the disc 36, water can be supplied to any desired combination of water outlets. The disc 36 and the plate 39 can comprise annular portions to allow for an efficient use of space when opening and closing the water outlets. In FIG. 6 the plate 39 has three annular portions. A first portion where the drain outlet is located and two outer annular portions 48, 49 where the water outlets are located. The annular portions 48, 49 of the plate 39 can correspond to annular portions of the disc, see below in conjunction with FIG. 7. The openings forming the water outlets 32 can be shaped as annulus sectors.

Figure 7:
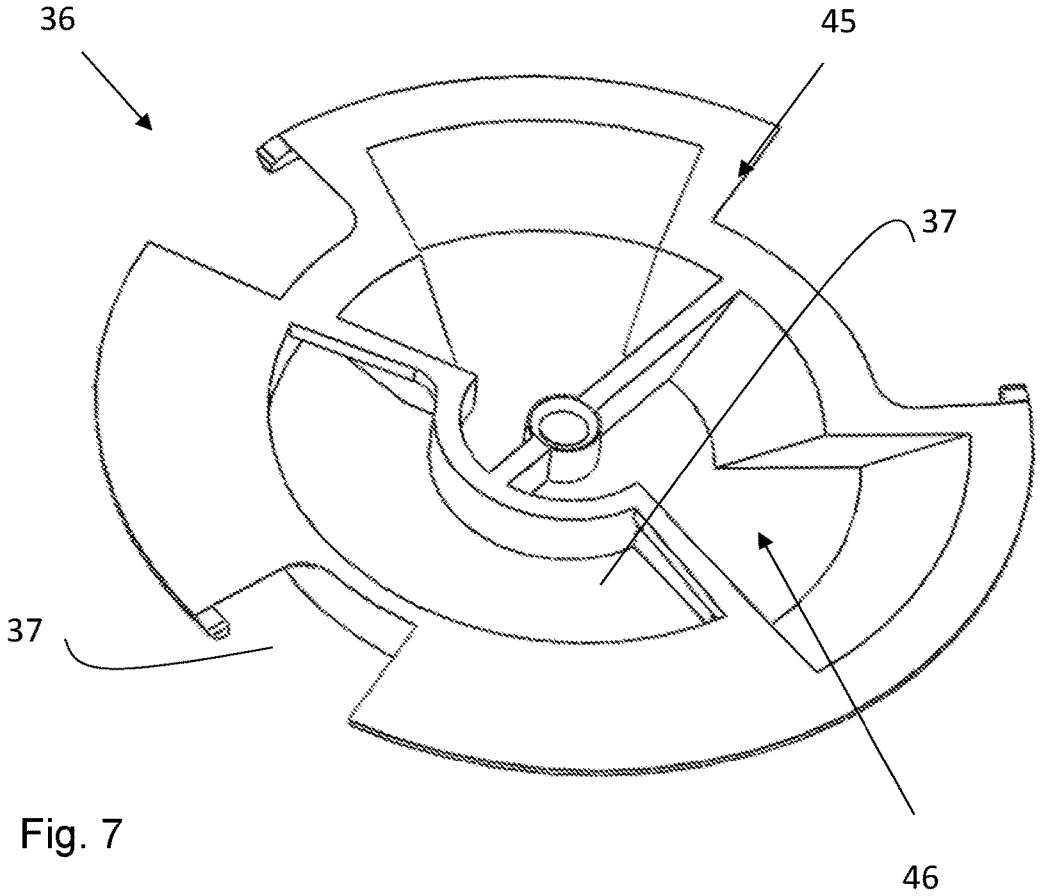
FIG. 7 is a view illustrating a rotatable disc for opening and closing water outlets of a flow controller in accordance with an embodiment.

In FIG. 7 the disc 36 is shown in more detail. The disc 36 is provided with openings 37. The openings 37 can be provided on an annulus shaped portion 45. The openings can advantageously be shaped as annulus sectors in the disc 36. In accordance with some embodiments multiple, at least two annulus shaped portions 45, 46, are provided. The at least two annulus shaped portions 45, 46 are typically located radially displaced. The at least two annulus shaped portions thereby form ring shaped portions located next to each other. The openings 37 are formed in the at least two annulus shaped portions. In accordance with one embodiment the openings 37 are shaped as annulus sectors.

In the embodiment depicted in FIGS. 6 and 7 there are six different outlets, which are placed at three different radii of the flow controller 30. The drain outlet 35 is closest to the center or at the center at a first, inner, radius, and can be in fluid communication with the five water outlets 32 when these are closed.

The water outlets to a middle and to a top spray-arm can be placed at a second, intermediate, radius. The water outlets to the spray arm are preferably larger than the other water outlets to allow for a high water flow. Hence these outlets on the second radius can be large compared to the other water outlets. The water outlet to a bottom spray-arm and to other water outlets can be located at a third outmost radius. The water outlets on the largest radius can be smaller than the water outlets on the intermediate radius.

In accordance with some embodiments the flow controller 30 can be configured such that the water outlets 32 at the largest radius is provided with a water outlet that is half the angular width of the water outlets at a radius inside the largest radius, such as the intermediate radius in the example above.

In the exemplary embodiment of FIGS. 6 and 7, the outer smaller outlet can go from open to closed in 30 deg=12 on/off per full turn. The two openings at the intermediate radius can go from open to closed in 60 deg=6 on/off full turn. In an exemplary embodiment with a 1/12 section between the two larger openings there are 8 positions were the openings are fully opened or closed and the smaller outlets can have different combinations of openings together with the 8 positions of the two larger outlets.

The invention claimed is:

1. A flow controller for controlling water flow from a pump pumping water from a sump of a dish washer to a water conduit system of the dishwasher, the flow controller comprising:

a plate with openings forming water outlets to the water conduit system, and a disc rotatably arranged in relation to the plate, the disc comprising openings arranged for allowing closing and opening of the water outlets in the plate during rotation of the disc;

wherein the flow controller comprises a cavity formed between the disc and the plate configured to allow water to flow back from the water conduit system via a water outlet in the plate being closed by the disc and via the cavity to a drain outlet in the plate whereby water can return from a closed water outlet in the plate via the drain outlet in the plate to the sump.

2. The flow controller according to claim 1, wherein the cavity is formed by at least one channel in the disc.

3. The flow controller according to claim 2, wherein said at least one channel runs in a radial direction in the disc.

4. The flow controller according to claim 1, wherein the drain outlet in the plate is located radially inside the water outlet.

5. A dishwasher comprising the flow controller according to claim 1.

6. The dishwasher according to claim 5, wherein the drain outlet is in fluid connection with at least one spray arm when a water outlet to said at least one spray arm is closed by the disc.

7. The dishwasher according to claim 5, wherein the drain outlet is in fluid connection with at least one water tank when a water outlet to said at least one water tank is closed by the disc.

* * * * *